US008809802B2

(12) United States Patent
Sung et al.

(10) Patent No.: US 8,809,802 B2
(45) Date of Patent: Aug. 19, 2014

(54) PORTABLE ION GENERATOR

(75) Inventors: Bong Jo Sung, Changwon-si (KR); Hyung Ho Park, Changwon-si (KR); Jae Soo Jang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/522,627

(22) PCT Filed: Jan. 14, 2011

(86) PCT No.: PCT/KR2011/000297
§ 371 (c)(1),
(2), (4) Date: Jul. 17, 2012

(87) PCT Pub. No.: WO2011/090295
PCT Pub. Date: Jul. 28, 2011

(65) Prior Publication Data

US 2012/0305799 A1 Dec. 6, 2012

(30) Foreign Application Priority Data

Jan. 21, 2010 (KR) ..... 10-2010-0005479

(51) Int. Cl.
*H01T 23/00* (2006.01)
*H01J 1/02* (2006.01)

(52) U.S. Cl.
USPC ..... 250/423 R; 361/230

(58) Field of Classification Search
USPC ..... 250/423 R–423 F; 361/230, 231
See application file for complete search history.

(56) References Cited

U.S. PATENT DOCUMENTS

| | | | | |
|---|---|---|---|---|
| 5,484,472 | A * | 1/1996 | Weinberg | 96/26 |
| 7,256,979 | B2 * | 8/2007 | Sekoguchi et al. | 361/231 |
| 2005/0269519 | A1 * | 12/2005 | Kim et al. | 250/423 R |
| 2006/0238952 | A1 * | 10/2006 | Huang et al. | 361/212 |
| 2008/0157712 | A1 * | 7/2008 | Garcia | 320/101 |
| 2008/0217556 | A1 * | 9/2008 | Kagawa et al. | 250/423 R |
| 2009/0010801 | A1 * | 1/2009 | Murphy et al. | 422/4 |
| 2009/0042502 | A1 * | 2/2009 | Kim et al. | 454/139 |
| 2011/0097812 | A1 * | 4/2011 | Bather et al. | 436/153 |

FOREIGN PATENT DOCUMENTS

| | | | |
|---|---|---|---|
| CN | 1400700 | Y | 3/2003 |
| CN | 2590225 | Y | 12/2003 |
| CN | 1492554 | | 4/2004 |
| CN | 1492555 | | 4/2004 |
| CN | 201040721 | Y | 3/2008 |
| CN | 201049089 | Y | 4/2008 |
| KR | 102006-0053843 | A | 5/2006 |
| WO | 2004/008597 | A1 | 1/2004 |

* cited by examiner

*Primary Examiner* — Nicole Ippolito
*Assistant Examiner* — David E Smith
(74) *Attorney, Agent, or Firm* — McKenna Long & Aldridge, LLP

(57) ABSTRACT

An ion generator is disclosed. The ion generator has improved portability and ion generation efficiency. As is apparent from the above description, the ion generator according to the present invention is configured so that the discharge unit is constituted by the felts, and the piezoelectric element, not the coil type transformer, is used in the high voltage generation unit which generates high voltage. Consequently, the present invention has the effect of improving portability of the ion generator and the present invention has the effect of improving ion generation efficiency although the portability of the ion generator is improved by configuring the ion generator according to the present invention so that the discharge unit is constituted by the felts, and the piezoelectric element, not the coil type transformer, is used in the high voltage generation unit which generates high voltage.

16 Claims, 8 Drawing Sheets

(a)

(b)

[Fig. 8]
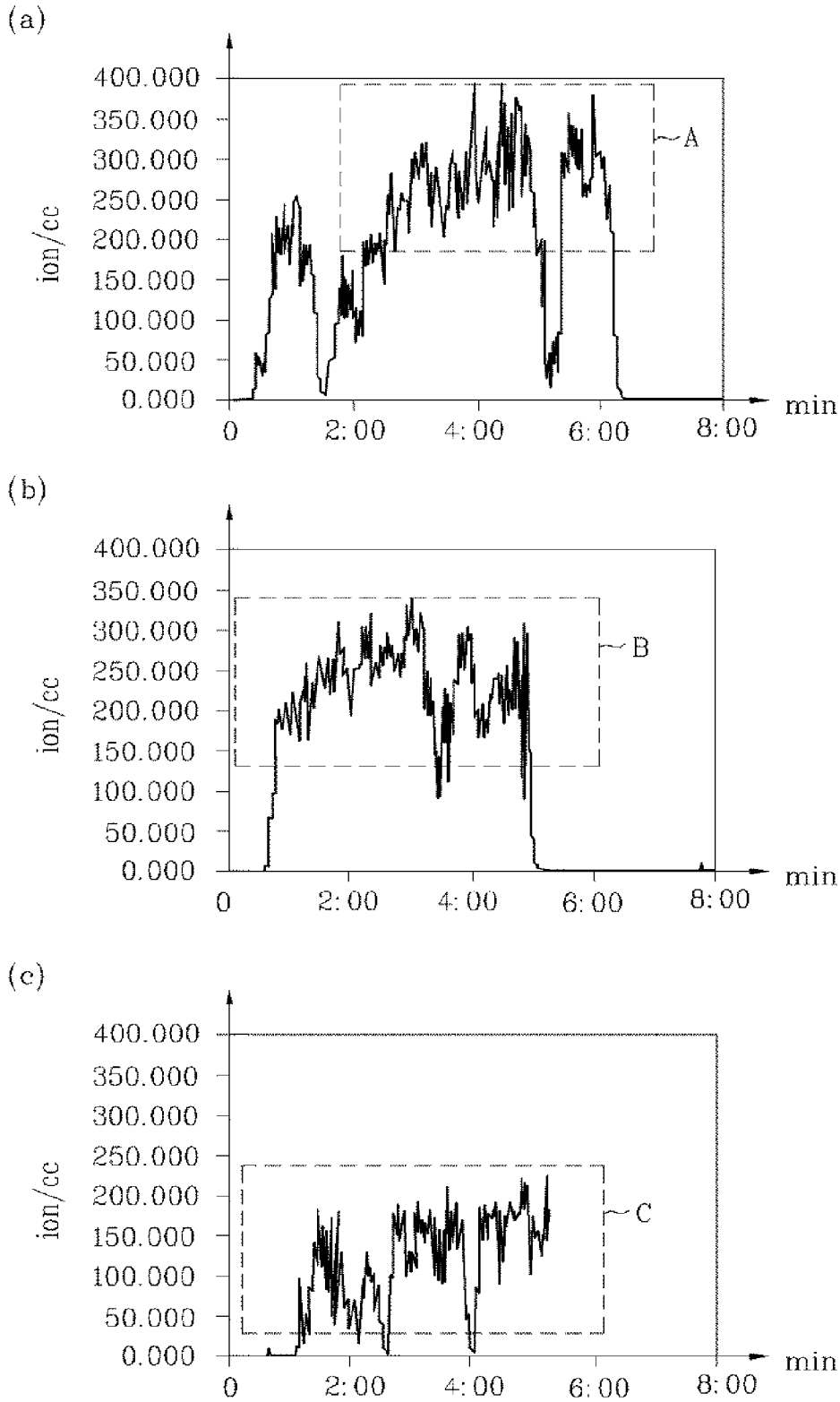

PORTABLE ION GENERATOR

This application is a National Stage Entry of International Application No. PCT/KR2011/000297, filed Jan. 14, 2011, and claims the benefit of Korean Application No. 10-2010-0005479, filed on Jan. 21, 2010, each of which is hereby incorporated by reference for all purposes as if fully set forth herein.

TECHNICAL FIELD

The present invention relates to a portable ion generator having improved portability and ion generation efficiency.

BACKGROUND ART

The present invention relates to a portable ion generator. More particularly, the present invention relates to a portable ion generator wherein the ion generator is so compact-sized that the ion generator is conveniently carried, the life span of a discharge unit is lengthened, and power easily obtainable from the surroundings is used.

As environmental pollution becomes serious, the number of people who suffer from various respiratory diseases or allergic diseases due to polluted air has increased. For this reason, various attempts have been made to generate negative ions, thereby purifying polluted air and thus improving quality of air.

Ions include positive ions and negative ions. The negative ions are oxygen or nitrogen molecules in air having negative charges.

In recent years, it has been proved that negative ions are effective in removal of dust, smell, and noxious chemical materials and thus very helpful to a human body. Therefore, an ion generator is increasingly mounted in various electronic products, such as air conditioners for home use, hair dryers, water purifiers, air conditioners for vehicles, and other air conditioners for indoor heating and cooling.

Also, air conditioners having a negative/positive ion generator for generating positive ions as well as negative ions to purify air have been proposed in consideration of the fact that it is not possible to effectively remove bacteria floating in air by generating only negative ions. In particular, the positive ions are used to form positive (+) cluster ions, which are necessary to form OH radicals in air.

Based on a principle of generating ions, the ion generator may be classified as a corona discharge type ion generator, an electron emission type ion generator, an ion generator using a Lenard effect, or an ion generator using a-rays.

The ion generator using a Lenard effect and the ion generator using a-rays are expensive and are mainly used for industry. For these reasons, the ion generator using a Lenard effect and the ion generator using a-rays are not applied to electric home appliances.

Therefore, the electron emission type ion generator, which selectively generates positive ions or negative ions, may be widely used. In the electron emission type ion generator, pulse type high voltage is applied to a discharge unit to directly emit electrons in air, thereby generating negative ions.

The emitted electrons are coupled to air molecules to generate negative ions. In the electron emission type ion generator, a larger amount of negative ions is generated than in the corona discharge type ion generator, in which ground electrodes are opposite to tips. In the electron emission type ion generator, the discharge area is small, thereby reducing an amount of ozone generated. In recent years, therefore, the electron emission type ion generator has been widely used.

Generally, a material having a tip end is used as a discharge tip in order to apply high voltage to air. This is because, although the same voltage is applied, higher voltage is applied to a tip having a smaller radius. This principle is equally applied to the electron emission type ion generator.

In the related art, a needle type discharge unit, the end of which is artificially sharpened, or a wire type discharge unit is used as the discharge tip. For a tip manufactured through physical processing, however, reducing the radius of the tip is limited. As a result, an amount of ions generated per area is small due to the physical size of the tip. In addition, the volume of the tip is increased, and power consumption is also increased.

The radius of the needle type discharge unit or the wire type discharge unit is minimized to apply higher voltage with the result that an amount of ions generated per area is small and a discharge surface of the needle type discharge unit or the wire type discharge unit is easily oxidized.

In conventional ion generators, a high voltage generation unit for applying pulse type high voltage to the discharge unit includes a transformer having coils. However, the volume of such a high voltage generation unit is large.

Also, the conventional ion generators have been added to air purifiers or air conditioners using alternating current power to generate ions.

DISCLOSURE OF INVENTION

Technical Problem

Users do not dwell in specific spaces and wish to conveniently generate ions in spaces in which the users move or dwell, thereby enjoying pleasantness.

There is a necessity for improving portability of ion generators while preventing the reduction of ion generation efficiency in order to satisfy such user demands.

Solution to Problem

Accordingly, the present invention is directed to a portable ion generator that substantially obviates one or more problems due to limitations and disadvantages of the related art.

An object of the present invention is to provide a portable ion generator having improved portability and ion generation efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a portable ion generator includes a high voltage generation unit including a piezoelectric element, at least one discharge unit connected to the high voltage generation unit, the discharge unit including a felt formed of activated carbon fibers, a power supply unit to which an external direct current power supply terminal is detachably connected, at least one board to which the high voltage generation unit or the discharge unit is mounted, and a housing in which the board is disposed.

The discharge unit may include a positive ion discharge unit for generating positive ions and a negative ion discharge unit for generating negative ions.

The high voltage generation unit and the discharge unit may be mounted to different boards.

The board may include an upper board and a lower board, the discharge unit may be mounted to the upper board, and the high voltage generation unit may be mounted to the lower board.

The power supply terminal may be provided at the lower board.

External direct current power supplied to the power supply terminal may have a voltage of 3 volts to 6 bolts and a current of 300 mA to 1000 mA.

The power supply unit may include a standard terminal for charging a cellular phone.

The discharge unit may be mounted to one surface of the upper board, and the discharge unit may be mounted to the top of a conductive member electrically connected to the high voltage generation unit.

The housing may include a first housing and a second housing for surrounding the board, one of the first and second housings may have at least one ion discharge hole through which ions generated from the discharge unit are discharged, and the other housing may have an opening through which the power supply unit is exposed.

The ion discharge hole may be formed at a position corresponding to the discharge unit.

Voltage applied to the discharge unit may include pulse voltage, and the pulse voltage may have different on time and off time lengths.

The on time length of the pulse voltage applied to the discharge unit may be shorter than the off time length of the pulse voltage applied to the discharge unit.

The positive ion discharge unit and the negative ion discharge unit may have a diameter of 30 mm or less, and the positive ion discharge unit and the negative ion discharge unit may be disposed so that the distance between centers of the positive ion discharge unit and the negative ion discharge unit is approximately 20 mm or more.

Voltage applied to the high voltage generation unit may be 11 volts to 13 volts.

The portable ion generator may further include an auxiliary boosting circuit for boosting direct current power supplied from the external direct current power supply terminal before supplying direct current power to the high voltage generation unit.

It is to be understood that both the foregoing general description and the following detailed description of the present invention are exemplary and explanatory and are intended to provide further explanation of the invention as claimed.

Advantageous Effects of Invention

As is apparent from the above description, the ion generator according to the present invention is configured so that the discharge unit is constituted by the felts, and the piezoelectric element, not the coil type transformer, is used in the high voltage generation unit which generates high voltage. Consequently, the present invention has the effect of improving portability of the ion generator.

Also, the present invention has the effect of improving ion generation efficiency although the portability of the ion generator is improved by configuring the ion generator according to the present invention so that the discharge unit is constituted by the felts, and the piezoelectric element, not the coil type transformer, is used in the high voltage generation unit which generates high voltage.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 8 is a graph illustrating experiment data on ion generation performance of the ion generator according to the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
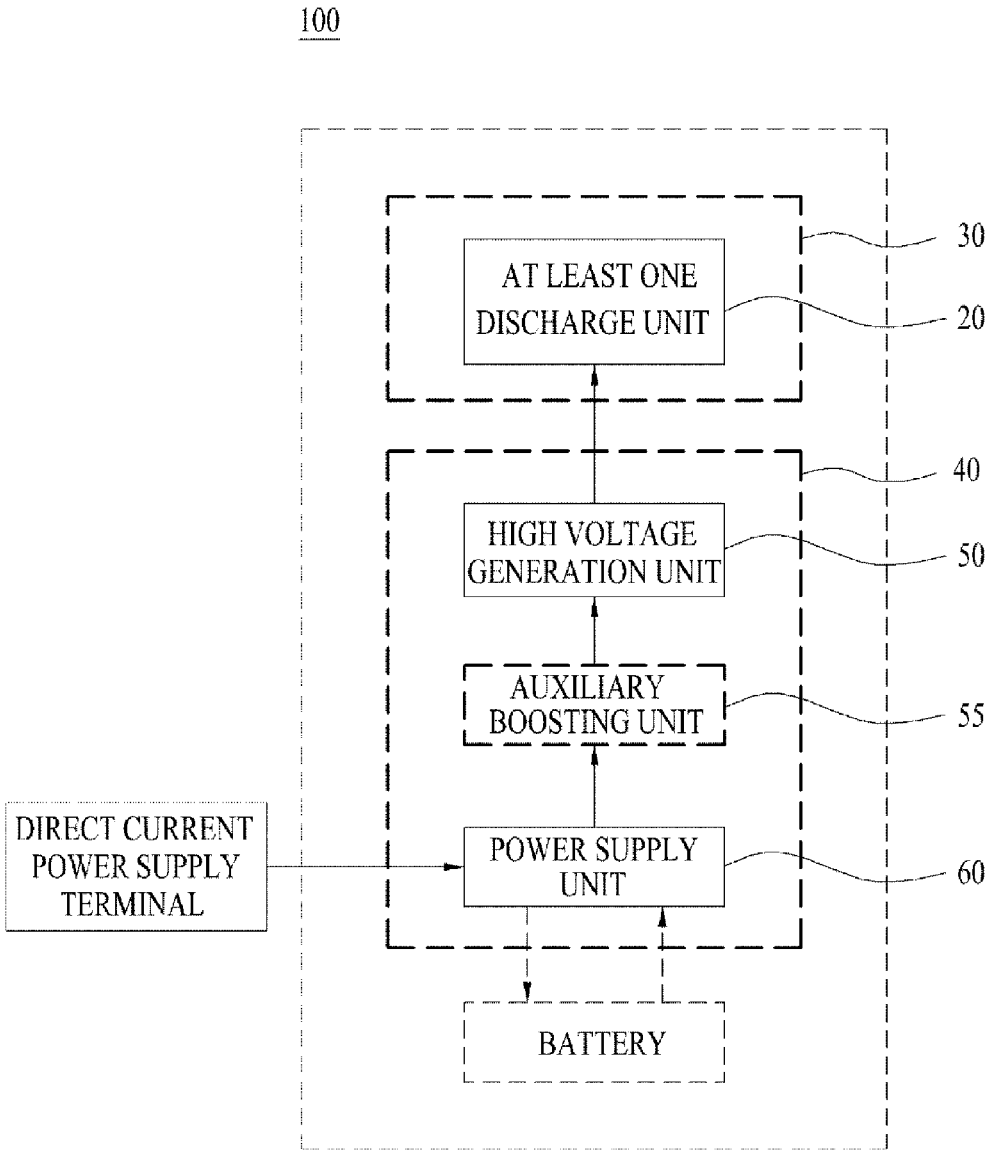
FIG. 1 is a construction view illustrating an ion generator according to the present invention.

FIG. 1 is a construction view illustrating an ion generator according to the present invention.

The ion generator according to the present invention includes a high voltage generation unit 50 having a piezoelectric element, at least one discharge unit 20 connected to the high voltage generation unit 50, the discharge unit 20 having a felt formed of activated carbon fibers, a power supply unit 60 to which an external direct current power supply terminal is detachably connected, at least one board to which the high voltage generation unit 50 or the discharge unit 20 is mounted, and a housing in which the board is disposed.

Also, the portable ion generator may further include a battery 110 for storing electrical energy supplied from the power supply unit 60. The battery 110 enables the ion generator to be used even during movement of the ion generator. The battery 110 may be a rechargeable battery. The battery 110 supplies power necessary to generate ions to the ion generator when external direct current power is not supplied to the ion generator. As the battery is included in the ion generator, user utilization of the ion generator is further improved. A description of the ion generator with the battery will be described below in detail with reference to FIG. 6.

The ion generator according to the present invention uses direct current power, not alternating current power, so that portability of the ion generator is improved. An example of the direct current power supply terminal may be a direct current conversion adaptor which converts alternating current power into direct current power. The direct current power supply terminal is frequently used to supply power to portable small-sized electronic products. In particular, general-purpose adaptors may be easily obtained. Cellular phone chargers, which are frequently used, may be easily obtained from the surroundings and shared in user activity regions. Even though a user carries only the ion generator, therefore, the user may easily operate the ion generator at a place at which the user wishes to use the ion generator, thereby enjoying pleasantness.

The power supply unit 60 may be variously changeable based on the kind of the direct current power supply terminal.

In the high voltage generation unit 50 of the ion generator according to the present invention, a piezoelectric element, not a general coil type transformer, is used.

A piezoelectric element was made of quartz, tourmaline or potassium sodium tartrate long ago. An artificial crystal, such as barium titanate, ammonium dihydrogen phosphate or ethylenediamine tartrate, which has been recently developed, exhibits a high piezoelectric effect. Piezoelectricity is a phenomenon in which, when pressure is applied to a certain crystal plate in a predetermined direction, positive and negative charges proportional to the pressure are generated on opposite main surfaces of the crystal plate. A boosting circuit using such a piezoelectric element has been proposed. A description of a principle of boosting direct current voltage using a piezoelectric element will not be given.

Such a piezoelectric element is characterized in that the volume of the piezoelectric element is less than a coil type high voltage generation unit.

Voltage applied to the high voltage generation unit 50 having the piezoelectric element may be 11 volts to 13 volts. Generally, electronic products, such as an air conditioner, have an internal power of 11 volts to 13 volts. Therefore, it is preferable to design the piezoelectric element so that the piezoelectric element can be directly applied to the air conditioner. That is, a piezoelectric element for a portable ion generator is not additionally designed but a piezoelectric element is generally designed so that the piezoelectric element can be suitable for a power standard of general electronic products which are not portable and then the piezoelectric element may be applied to a portable ion generator.

A high voltage generation unit having a general piezoelectric element may be adopted. If voltage of external direct current power deviates from a range of 11 volts to 13 volts, an auxiliary boosting circuit 55 may be further provided to compensate for input voltage applied to the high voltage generation unit 50. The auxiliary boosting circuit 55 may be a coil type boosting circuit or a piezoelectric element type boosting circuit. Alternatively, the auxiliary boosting circuit 55 may use a rechargeable battery.

In a case in which a high voltage generation unit having a piezoelectric element using input voltage corresponding to voltage of external direct current power, the auxiliary boosting circuit 55 may be omitted.

Also, the ion generator according to the present invention includes at least one discharge unit 20.

The ion generator according to the present invention may include a positive ion discharge unit for generating positive ions and a negative ion discharge unit for generating negative ions.

Of course, a plurality of positive ion discharge units and a plurality of negative ion discharge units may be provided.

Also, the ion generator according to the present invention may include at least one board.

A board to which the high voltage generation unit 50 is mounted and a board to which the discharge unit 20 is mounted may be different from each other. That is, the discharge unit 20 and the high voltage generation unit 50 may be mounted to different boards 30 and 40, respectively. The board includes an upper board 30 and a lower board 40. The discharge unit 20 may be mounted to the upper board 30, and the high voltage generation unit 50 may be mounted to the lower board 40.

In the construction view of FIG. 1, the board to which the discharge unit 20 is mounted is referred to as the upper board 30, and the board to which the high voltage generation unit 50 is mounted and/or at which the power supply unit 60 is disposed is referred to as the lower board 40, for the convenience of description.

The reason that components of the ion generator are separately mounted to the upper board 30 and the lower board 40 is that it is necessary to prevent damage to the components of the ion generator due to sparks occurring as the result of the interaction between the high voltage generation unit 50 and the discharge unit 20.

The upper board 30 and the lower board 40 are disposed in the housing. Hereinafter, the structure of the ion generator according to the present invention will be described in detail with reference to FIG. 2.

Figure 2:
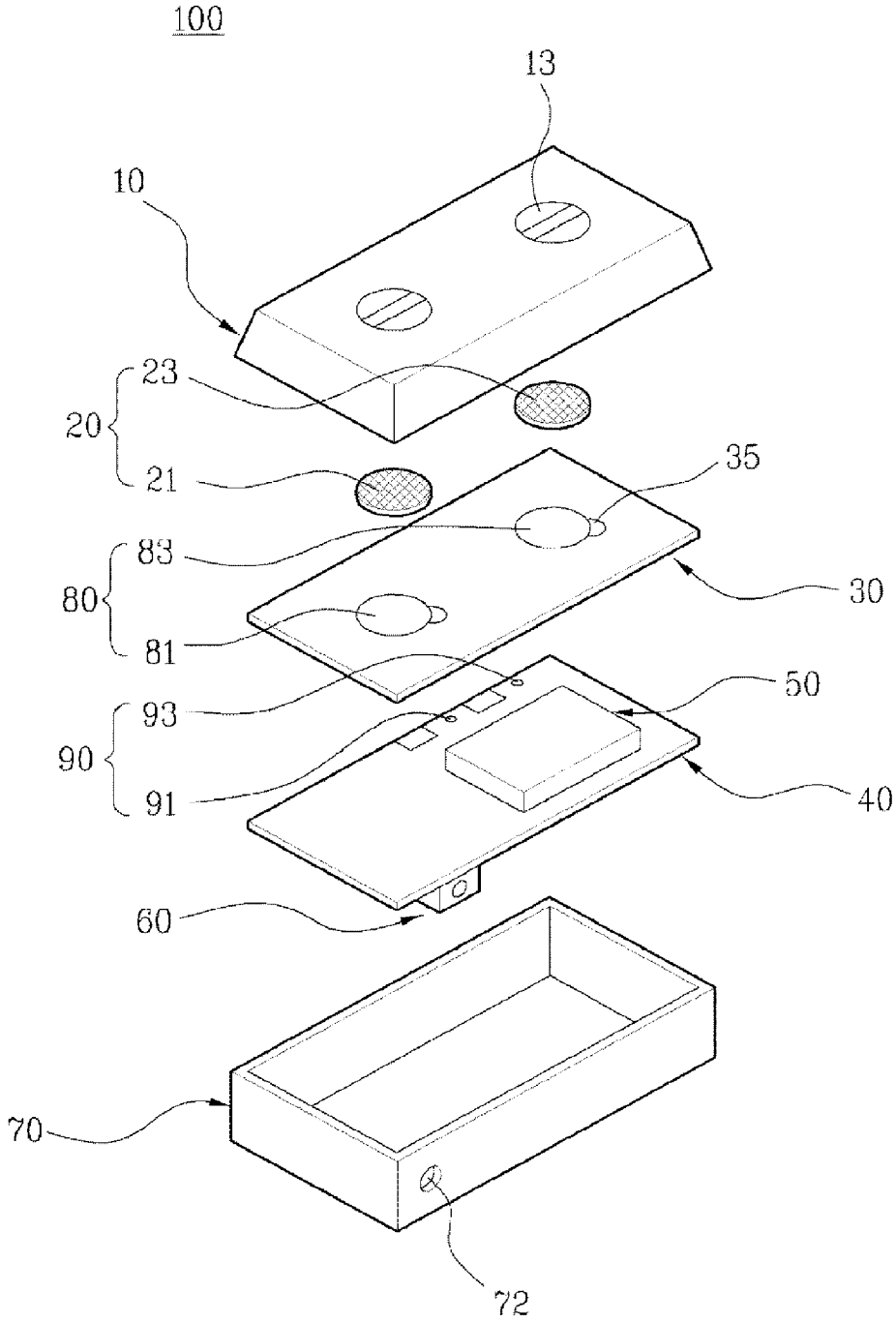
FIG. 2 is an exploded perspective view illustrating an embodiment of the ion generator according to the present invention.

FIG. 2 is an exploded perspective view illustrating an embodiment of the ion generator according to the present invention.

In this embodiment, an ion generator 100 includes a housing 10 and 70, a high voltage generation unit 50, a discharge unit 20, a battery, and a power supply unit 60.

The housing 10 and 70 may include an upper housing 10 and a lower housing 70. Upon the coupling of the upper housing 10 and the lower housing 70, a predetermined space (a reference numeral of which is not shown) may be defined between the upper housing 10 and the lower housing 70. The high voltage generation unit 50, the discharge unit 20 and the power supply unit 60 may be disposed in the space.

In the ion generator according to the present invention, as previously described, the upper board 30 and the lower board 40 may be disposed in the housing 10 and 70 in a stacked state.

At least one discharge port 13 may be formed at the upper housing 10. The discharge unit 20 may be mounted to the upper board adjacent to the upper housing 10 so that generated ions can be easily discharged.

The discharge unit 20 may have a felt (i.e., woolen fabric) formed of activated carbon fibers. The discharge unit 20 may include a positive ion discharge unit 21 for generating positive ions and a negative ion discharge unit 23 for generating negative ions.

As previously described, the positive ion discharge unit 21 and the negative ion discharge unit 23 may be disposed spaced apart from each other.

The upper board 30 may be formed of an insulative material, and first and second conductive members 81 and 83 are provided only at portions of the upper board 30 at which the positive ion discharge unit 21 and the negative ion discharge unit 23 are mounted so that voltage boosted by the high voltage generation unit 50, which will be described below, can be uniformly applied to the positive ion discharge unit 21 and the negative ion discharge unit 23.

Specifically, the conductive members 81 and 83 may be conductive tapes. The positive ion discharge unit 21 and the negative ion discharge unit 23 are primarily fixed to corresponding regions of the upper board 30 using such conductive tapes, and then the felts, which are formed of carbon fibers, of the discharge units 21 and 23 are pressed so that the discharge units 21 and 23 can be finally fixed.

That is, the discharge units 21 and 23 are mounted to one surface of the upper board 30, and the discharge units 21 and 23 are mounted to the tops of the conductive members 81 and 83 electrically connected to the high voltage generation unit 50.

Consequently, the size of the first and second conductive members 81 and 83 may correspond to the size of the positive ion discharge unit 21 and the negative ion discharge unit 23.

The upper board 30 may have connection holes 35 through which the upper board 30 is electrically connected to the high voltage generation unit 50 mounted to the lower board 40. The positive ion discharge unit 21 and the negative ion discharge unit 23 may be connected to the high voltage generation unit 50 via electric wires extending through the connection holes 35.

The high voltage generation unit 50 may be mounted to the lower board 40. The lower board 40 is provided at the bottom thereof with an input terminal (not shown) for supplying power from the power supply unit 60 to the high voltage generation unit 50. First and second output terminals 41 and 43, through which voltage boosted by the high voltage generation unit 50 is output, are provided at the top of the lower board 40. The first and second output terminals 41 and 43 correspond to positive and negative terminals, respectively.

The first and second output terminals 41 and 43 are connected to the positive ion discharge unit 21 and the negative ion discharge unit 23, respectively.

The power supply unit 60 may be provided at the lower board 40. As shown in FIG. 2, the power supply unit 60 may be directly mounted to the lower board 40. Alternatively, the power supply unit 60 may be connected to the lower board 40 or the high voltage generation unit 50 in a state in which the power supply unit 60 is mounted in the housing.

The power supply unit 60 is a part which is detachably mounted to an external direct current power supply terminal, such as an adapter.

As shown in FIG. 2, the power supply unit 60 may be a general-purpose circular adaptor terminal.

The lower housing 70 may have an opening 72 formed at a position corresponding to the power supply unit 60. The power supply unit 60 is exposed outward through the opening 72.

The ion generator according to the present invention uses a felt type discharge unit 20 formed of activated carbon fibers instead of a conventional tip electrode. Consequently, it is possible to eliminate a problem in that the conventional tip electrode is oxidized at a discharge region thereof, thereby increasing an amount of ions discharged by the discharge unit 20.

The ion generator according to the present invention includes a positive ion discharge unit 21 for generating positive ions and a negative ion discharge unit 23 for generating negative ions. As previously described, the positive ion discharge unit 21 and the negative ion discharge unit 23 are mounted to the upper board 30 in a state in which the positive ion discharge unit 21 and the negative ion discharge unit 23 are spaced apart from each other.

Each of the discharge units 21 and 23 may have a diameter of 30 mm or less. The discharge units 21 and 23 may be mounted to the upper board 30 in a state in which the distance between the centers of the respective discharge units 21 and 23 is approximately 20 mm. The distance between discharge units 21 and 23 may be adjusted in consideration of the size of each of the discharge units 21 and 2 so that ions generated by the respective discharge units 21 and 23 do not interfere with each other during discharge of the ions and interaction between respective discharge units 21 and 23 during a discharging process is minimized. Hereinafter, activated carbon fibers constituting the discharge unit 20 will be described in detail with reference to FIG. 3.

Figure 3:
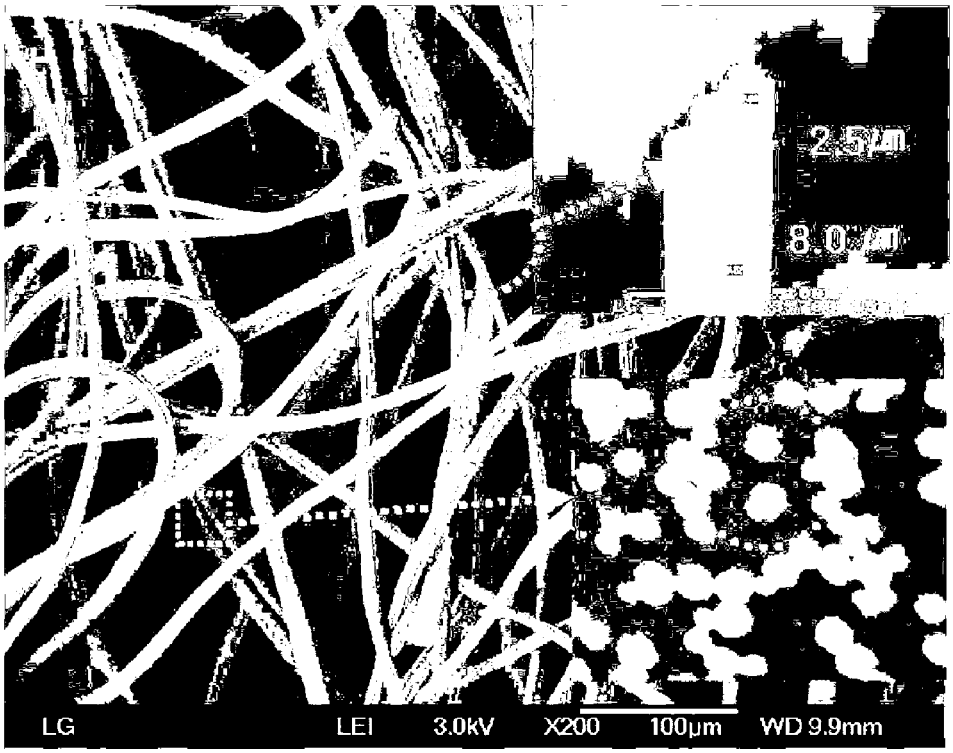
FIG. 3 is a photograph illustrating a micro structure of carbon fibers used as a discharge unit of the present invention.

FIG. 3 is a photograph illustrating a micro structure of carbon fibers used as the discharge unit of the present invention. As shown in FIG. 3, micro-sized activated carbon fibers are entwined complicatedly. An activated carbon fiber felt having a predetermined surface is manufactured by cutting the activated carbon fibers. Consequently, ends of the activated carbon fibers are located at the cut surface of the activated carbon fiber felt.

An activated carbon fiber felt manufactured using carbon fibers each having a diameter of several μm has a specific surface area of 1000 $m^2/g$ or more. Therefore, the activated carbon fiber felt has an air cleaning function based on adsorption of noxious materials. In the present invention, the activated carbon fiber felt at the surface of which the ends of the carbon fibers are located is used as a negative ion discharge unit.

That is, all the ends of a huge amount of the micro carbon fibers are used as ion generation tips, and therefore, it is possible to stably generate a large amount of ions from the whole surface of the activated carbon fiber felt.

An activated carbon fiber felt formed of such activated carbon fibers is woven in a textile form, and therefore, the size and shape of the activated carbon fiber felt may be easily defined. Also, the activated carbon fiber felt has a property to freely carry precious metal particles. The present invention may further have a function of uniformly distributing precious metal nano particles in the activated carbon fiber felt to remove microorganisms, such as germs and bacteria, from air in addition to generation of negative ions. Precious metal particles to which the present invention is applicable may include Ag, Pt, Au, Cu, Al, Cr, W, and Mo.

Specifically, the carbon fibers constituting the discharge unit may be coated with one of the above-mentioned metal materials. For example, the carbon fibers may be coated with nano Ag.

Meanwhile, micro-sized activated carbon fibers are entwined complicatedly. An activated carbon fiber felt having a predetermined surface is manufactured by cutting the activated carbon fibers. Consequently, ends of the activated carbon fibers are located at the cut surface of the activated carbon fiber felt.

As shown in FIG. 3, an activated carbon fiber felt manufactured using carbon fibers each having a diameter of several μm has a specific surface area of 1000 $m^2/g$ or more. Therefore, the activated carbon fiber felt has an air cleaning function based on adsorption of noxious materials.

In the present invention, the activated carbon fiber felt at the surface of which the ends of the carbon fibers are located is used as a negative ion discharge unit or a positive ion discharge unit. That is, all the ends of a huge amount of the micro carbon fibers are used as the negative ion discharge unit or the positive ion discharge unit, and therefore, it is possible to stably generate a large amount of negative ions or positive ions from the whole surface of the activated carbon fiber felt.

An activated carbon fiber felt formed of such activated carbon fiber is woven in a textile form, and therefore, the size and shape of the activated carbon fiber felt may be easily defined. Also, the activated carbon fiber felt has a property to freely carry precious metal particles.

The present invention may further have a function of uniformly distributing precious metal nano particles in the activated carbon fiber felt to remove microorganisms, such as germs and bacteria, from air in addition to generation of negative ions. Precious metal particles to which the present invention is applicable may be at least one selected from a group consisting of silver (Ag), platinum (Pt), gold (Au), copper (Cu), aluminum (Al), chrome (Cr), tungsten (W), and molybdenum (Mo).

The felt may be used as a negative ion discharge unit or a positive ion discharge unit. In a case in which it is necessary to purify air for pleasant environment, the felt may be used as only the negative ion discharge unit to generate negative ions. In a case in which it is necessary to sterilize germs or microorganisms in air, the felt may be used as only the positive ion discharge unit to generate positive ions.

Of course, a felt may be used as the negative ion discharge unit and another felt may be used as the positive ion discharge unit so as to simultaneously generate negative ions and positive ions as needed.

Current flows in activated carbon because the activated carbon is a conductive material. When high voltage is applied to the activated carbon, a high electric field is formed around carbon fibers constituting a felt, and free electrons passing by the carbon fibers are accelerated by the electric field. As a result, the free electrons collide with neutral molecules (oxygen, nitrogen, etc.) in air to ionize the molecules. The ionized molecules, acting as a condensation core, are coupled to moisture in air to form cluster ions, which collide with surfaces of bacteria or viruses to form OH radicals.

The OH radicals are coupled with hydrogen ions at the surface of the bacteria or viruses to form water molecules, thereby achieving inactivation.

As described above, the ion generator according to this embodiment of the present invention selectively discharges positive ions or negative ions. Consequently, it is possible to generate a large amount of cluster ions, preventing generation of secondary contaminants, such as ozone and nitrogen oxide, achieving deodorization and sterilization, and continuously providing air helpful in human metabolism. As described above, the ion generator 100 according to this embodiment of the present invention selectively discharges positive ions or negative ions. Consequently, it is possible to generate a large amount of cluster ions, preventing generation of secondary contaminants, such as ozone and nitrogen oxide, achieving deodorization and sterilization, and continuously providing air helpful in human metabolism.

As previously described, it is preferable to dispose the two adjacent felts (the positive ion discharge unit and the negative ion discharge unit) so that the two adjacent felts are spaced a predetermined distance from each other in consideration of electrical stability, bactericidal activity, antibiosis, and an amount of ions generated. That is, if the two adjacent discharge units are disposed so that the two adjacent discharge units are spaced less than the predetermined distance from each other, sparks may be generated during generation of ions.

Figure 4:
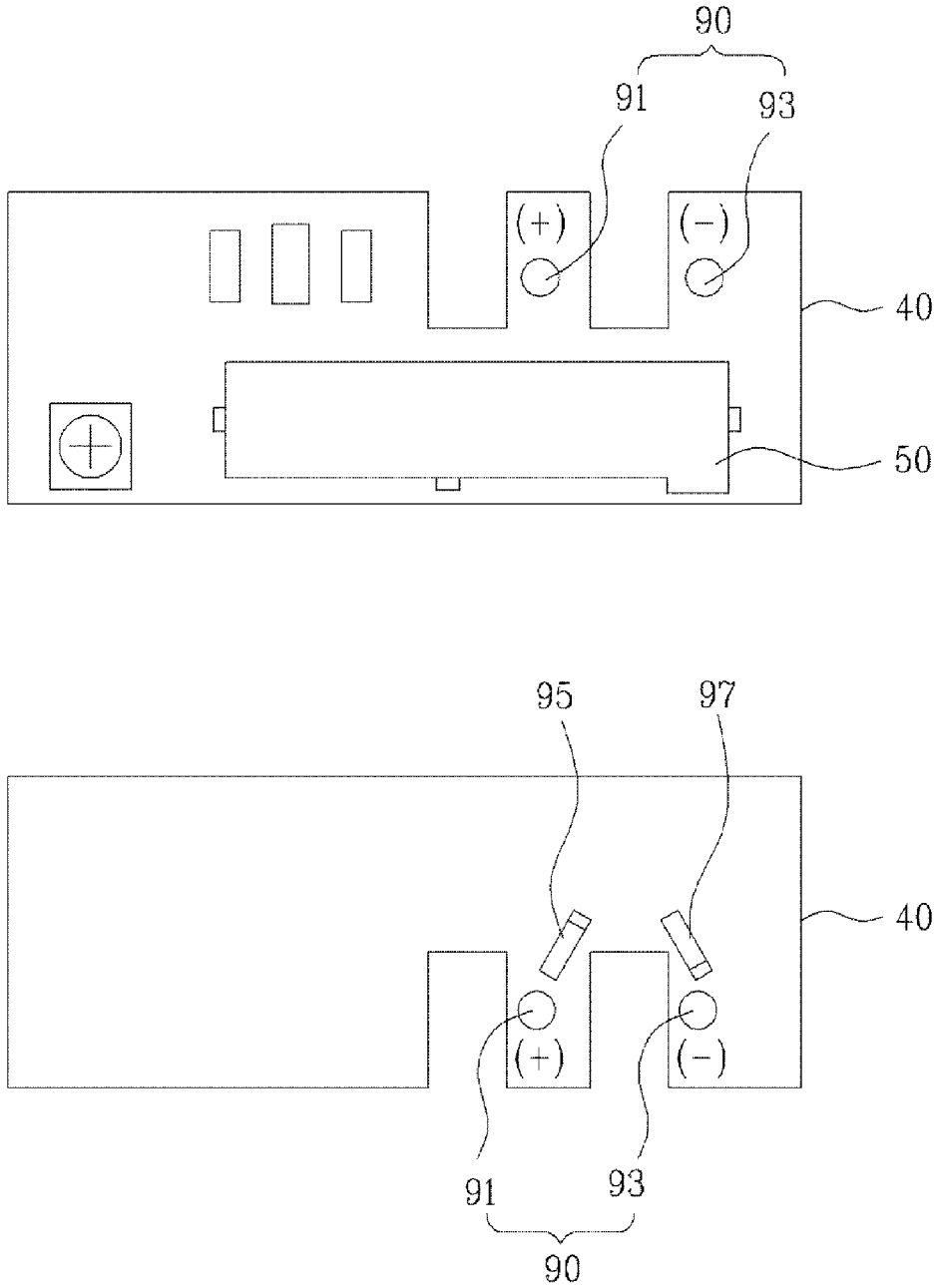
FIG. 4 is a plan view illustrating a board to which a high voltage generation unit of the ion generator according to the present invention is mounted.

FIG. 4 is a plan view of the lower board 40 to which the high voltage generation unit 50 of the ion generator according to the present invention is mounted.

Specifically, FIG. 4(*a*) is a plan view of the lower board 40 when viewed from top, and FIG. 4(*b*) is a plan view of the lower board 40 when viewed from bottom.

The high voltage generation unit 50 may be mounted to the top of the lower board 40.

In order to generate negative ions or positive ions through the respective discharge units 20, cathode high voltage or anode high voltage is applied to the conductive members 80 electrically connected to the respective discharge units 20. The high voltage generation unit 50 serves to output such high voltage.

As previously described, the conductive members 81 and 83 are electrically connected to output terminals 91 and 93 provided at the lower board 40. One of the conductive members 81 and 83 may be connected to a corresponding one of the output terminals 91 and 93.

If the first conductive member 81, which is one of the conductive members 81 and 83, is a place at which the first discharge unit 21 for generating positive ions is mounted, the first conductive member 81 may be connected to the first output terminal 91, which is one of the output terminals 91 and 93. If the second conductive member 83, which is one of the conductive members 81 and 83, is a place at which the second discharge unit 23 for generating negative ions is mounted, the second conductive member 83 may be connected to the second output terminal 93, which is one of the output terminals 91 and 93.

Voltage is boosted by the high voltage generation unit 50 and is then applied to the first discharge unit 21 and the second discharge unit 23 via the first output terminal 91 and the second output terminal 93, respectively.

The high voltage generation unit 50 serves to boost voltage to several kV, which is necessary to generate negative ions or positive ions. The voltage output from the high voltage generation unit 50 is divided into anode high voltage and cathode high voltage, which are supplied to the positive ion discharge unit 21 and the negative ion discharge unit 23, respectively.

As shown in FIG. 4, the lower board 40 may be provided with a plurality of diodes 95 and 97 for dividing high voltage output from the high voltage generation unit 50 into anode high voltage and cathode high voltage and supplying the anode high voltage and the cathode high voltage to the discharge units 20.

Figure 5:
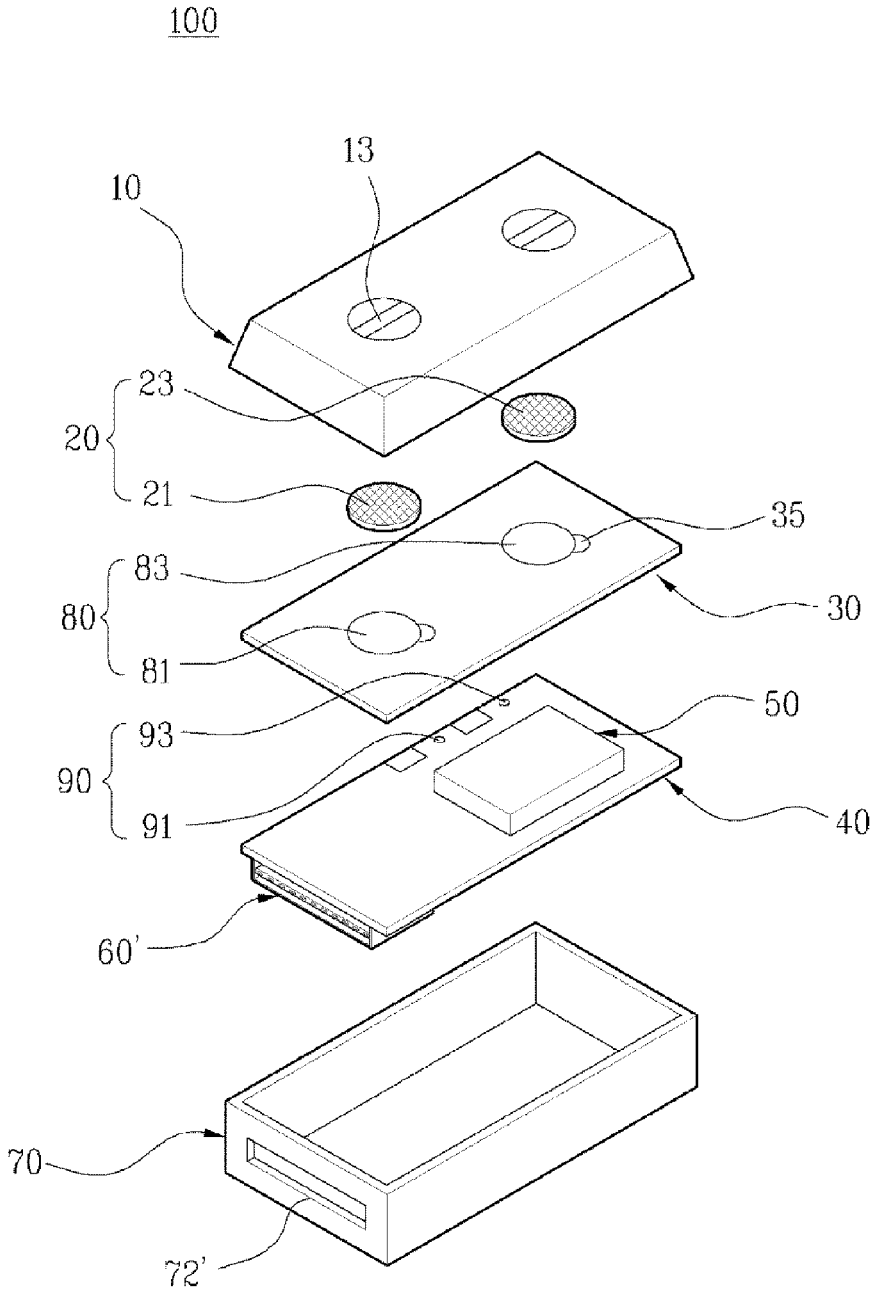
FIG. 5 is an exploded perspective view illustrating another embodiment of the ion generator according to the present invention.

FIG. 5 is an exploded perspective view illustrating another embodiment of the ion generator according to the present invention. A description of components of the ion generator according to this embodiment identical to those of the ion generator according to the previous embodiment shown in FIGS. 2 to 4 will not be given.

In this embodiment shown in FIG. 5, an external direct current power supply terminal may be a general-purpose cellular phone adapter. A power supply unit 60', to which the direct current power supply terminal is detachably connected, may have a terminal corresponding to the direct current power supply terminal.

For example, if a domestic direct current power supply terminal is a 24-pin or 20-pin terminal satisfying a standard of Telecommunications Technology Association (TTA), the power supply unit 60' may have a 24-pin or 20-pin terminal satisfying the standard of TTA. The direct current power supply terminal and the terminal of the power supply unit may be changed depending upon nations or cellular phone manufacturers.

Also, external direct current power supplied to the direct current power supply terminal may have a voltage of 3 volts to 6 bolts. In addition, the external direct current power may have a current of 300 mA to 1000 mA.

Of course, a portable terminal adaptor may directly decompress and convert alternating current power into direct current power. Alternatively, the portable terminal adaptor may be configured in the form of a cable which directly supplies direct current power from a universal serial bus (USB) terminal of a computer, etc. The USB terminal supplies power of 5 volts or less and 500 mA or less. Therefore, the USB terminal may be used to supply power to the ion generator according to this embodiment.

In this embodiment shown in FIG. 5, the power supply unit 60' may be provided at one end of a lower board 40 in the longitudinal direction. Specifically, the power supply unit 60' may be provided at one end of the bottom of the lower board 40 in the longitudinal direction.

Also, an opening 72' corresponding to the power supply unit 60' may be provided at an upper housing 70.

Figure 6:
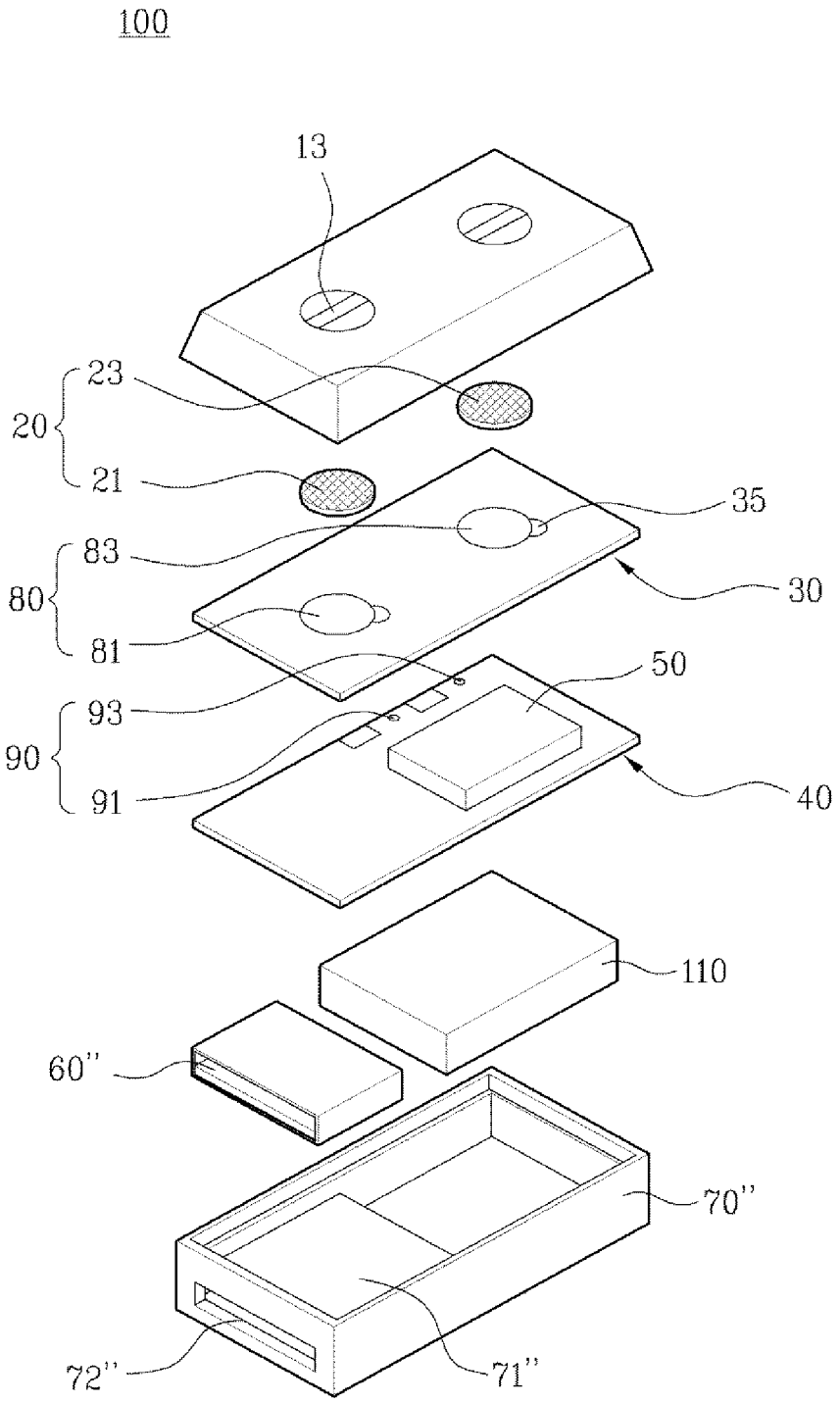
FIG. 6 is an exploded perspective view illustrating a further embodiment of the ion generator according to the present invention.
Figure 7:
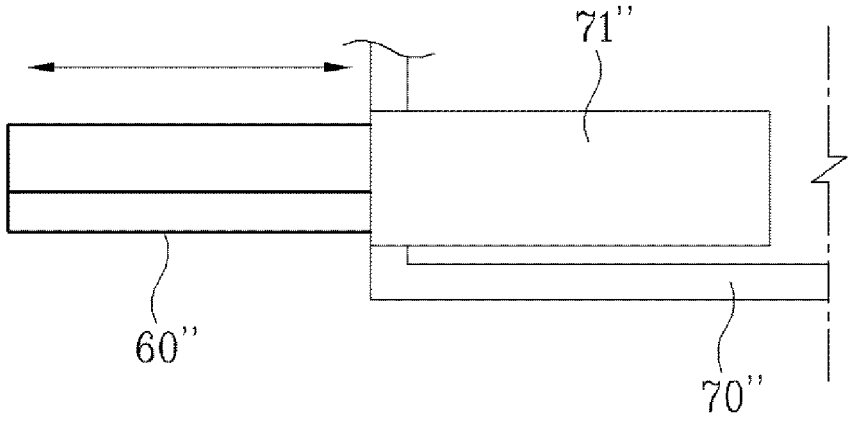
FIG. 7 is a sectional view illustrating a power supply unit of the ion generator shown in FIG. 6.
Figure 7:
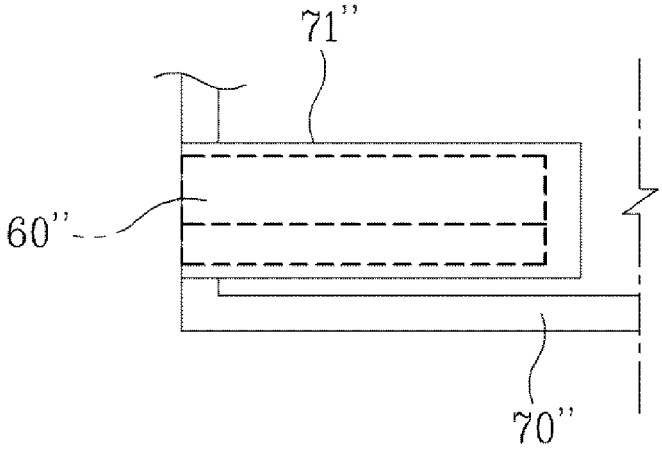

FIG. 6 is an exploded perspective view illustrating a further embodiment of the ion generator according to the present invention, and FIG. 7 is a sectional view illustrating a power supply unit of the ion generator shown in FIG. 6. A description of components of the ion generator according to this embodiment identical to those of the ion generators according to the previous embodiments shown in FIGS. 2 to 5 will not be given.

In this embodiment shown in FIG. 6, the ion generator further includes a battery 110 which stores external power.

Also, in this embodiment shown in FIG. 6, a power supply unit 60", to which external direct current power is supplied from a direct current power supply terminal, may be a general-purpose USB port.

Therefore, the ion generator 100 according to this embodiment of the present invention can be carried, and external power is supplied to the ion generator 100 via from an external device, such as a personal computer or a laptop computer, via a USB port. Alternatively, external power applied through the power supply unit 60" may be stored into the battery 110 so that the ion generator 100 can be operated using power stored in the battery 110.

The USB port may substitute various conventional series or parallel type connections. The USB port was developed for computers; however, in recent years, the USB port has been adopted in display devices, such as televisions, refrigerators, and air conditioners. In addition, the USB port is used for charging based on a power supply function of the USB port.

The power supply unit 60" configured in the form of the USB port may be mounted so that the USB port can be slidably drawn outward through an opening 72" formed at a lower housing 70".

That is, a slide guide (not shown) may be provided in a mounting part 71" of the lower housing 70" so that the slide guide can be slidably drawn outward.

The power supply unit 60" and the battery 110 may be provided at the bottom of the lower board 40.

The power supply unit 60" and the battery 110 may be electrically connected to each other via the lower board 40. The lower board 40 may have a circuit (not shown) for electrical connection between the power supply unit 60" and the battery 110. Also, the battery 110 and a high voltage generation unit 50 may be electrically connected to each other via the lower board 40.

Power applied from an external device has a low voltage of several volts. Consequently, the power directly applied from the external device may be stored into the battery 110, and the power stored in the battery 110 may be primarily boosted to approximately 12 volts through an auxiliary boosting unit 55. The boosted power may be supplied to the high voltage generation unit 50.

FIG. 8 is a graph illustrating experiment data on ion generation performance of the ion generator according to the present invention.

Specifically, FIG. 8(*a*) is a graph illustrating an amount of ion generated from the ion generator according to the present invention based on time, FIG. 8(*b*) is a graph illustrating an amount of ion generated from the ion generator based on time in a case in which a conventional coil type transformer, not a piezoelectric element, is used in the high voltage generation unit 50, and FIG. 8(*c*) is a graph illustrating an amount of ion generated from the ion generator based on time in a case in which a conventional coil type transformer, not a piezoelectric element, is used in the high voltage generation unit 50 and the discharge units are constituted by conventional tip electrodes.

Boosted voltage applied to the respective discharge units 21 and 23 may be pulse type voltage. That is, pulse voltage may be applied to the respective discharge units 21 and 23. The pulse voltage may have different on time and off time lengths. Preferably, the on time length of the pulse voltage applied to the discharge units 21 and 23 is shorter than the off time length of the pulse voltage applied to the discharge units 21 and 23.

Upon application of pulse type voltage, the on time length of the applied voltage is 5 ms, and the off time length of the applied voltage is 17 ms.

Also, in case of FIG. 8(*a*), in which the piezoelectric element is used, input voltage applied to the high voltage generation unit 50 having the piezoelectric element is 12 volts. Also, in case of FIGS. 8(*b*) and 8(*c*), power supplied to the ion generator is alternating current power (110 V or 220 V), not direct current power.

Experiments were carried out as follows. Air from a blowing device was blown to the ion generator, which was generating ions, at a predetermined flow rate (for example, not less than 300 liters/min), and the ions were measured by an ion measuring instrument located at a position which was a predetermined distance (approximately 1 meter) from the ion generator.

Also, the ion generator which simultaneously generated positive ions and negative ions was used in all of the three experiments. An amount of ions measured by the ion measuring instrument was decided based on the number of ions (ions/cc) measured in air having a predetermined volume. A larger amount of positive ions and negative ions measured indicates a higher ion generation performance.

The discharge unit used in the experiments had a diameter of 13 mm and a thickness of 1 mm.

It can be seen from the graph of FIG. 8(*a*) that an average amount of ions generated was greater in a case in which the piezoelectric element, not the coil type transformer, was used in the high voltage generation unit constituting the ion generator and electrodes constituted by felts formed of activated carbon fibers, not tip electrodes, were used in the discharge unit than in a case in which the coil type transformer was used in the high voltage generation unit and the electrodes constituted by the felts were used in the discharge unit and than in a case in which the coil type transformer was used in the high voltage generation unit and the tip electrodes were used in the discharge unit.

Since input voltage is supplied in a pulse form, it can be seen that the amount of measured ions was measured in a pattern in which the amount of measured ions was sharply increased and decreased repeatedly.

In the respective experiment results, regions A, B and C are regions at which ions are normally generated from the ion generator. It can be seen that the amount of ions generated at the region A was greater than the amount of ions generated at the regions B and C.

That is, in a case in which the piezoelectric element, not the coil type transformer, is used in the high voltage generation unit and the discharge unit is constituted by the felts, not the conventional tip electrodes (the region A), it can be seen that the size of the ion generator is further reduced, and ion generation efficiency is further improved.

That is, the discharge unit is constituted by the felts, and the piezoelectric element, not the coil type transformer, is used in the high voltage generation unit which generates high voltage, with the result that the size of the ion generator can be reduced to the extent that the ion generator can be carried, and the ion generation efficiency is further improved.

Also, in the ion generator according to the present invention, external direct current power can be easily obtained from cellular phone chargers, thereby further improving the portability and utilizability of the ion generator.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A portable ion generator comprising:

a high voltage generation unit comprising a piezoelectric element;

at least one discharge unit connected to the high voltage generation unit, the discharge unit comprising a felt formed of activated carbon fibers containing uniformly distributed precious metal nanoparticles;

a power supply unit to which an external direct current power supply terminal is detachably connected;

at least one board to which the high voltage generation unit or the discharge unit is mounted; and a housing in which the board is disposed, wherein the discharge unit comprises a positive ion discharge unit for generating positive ions and a negative ion discharge unit for generating negative ions, wherein the board comprises an upper board and a lower board, the discharge unit is mounted to the upper board, and the high voltage generation unit is mounted to the lower board, wherein a first and a second output terminals, through which voltage boosted by the high voltage generation unit is output, are provided at the lower board, wherein the first and th second output terminals are connected to the positive ion discharge unit and the negative ion discharge unit, respectively, and wherein the lower board is provided with a plurality of diodes for dividing high voltage output from the high voltage generation unit into anode high voltage and cathode high voltage.

2. The portable ion generator according to claim 1, wherein the power supply terminal is provided at the lower board.

3. The portable ion generator according to claim 2, wherein external direct current power supplied to the power supply terminal has a voltage of 3 volts to 6 volts and a current of 300 mA to 1000 mA.

4. The portable ion generator according to claim 3, wherein the power supply unit comprises a standard terminal for charging a cellular phone.

5. The portable ion generator according to claim 1, wherein the discharge unit is mounted to one surface of the upper board, and the discharge unit is mounted to a top of a conductive member electrically connected to the high voltage generation unit.

6. The portable ion generator according to claim 1, wherein the housing comprises a first housing and a second housing for surrounding the board, one of the first and second housings has at least one ion discharge hole through which ions generated from the discharge unit are discharged, and the other housing has an opening through which the power supply unit is exposed.

7. The portable ion generator according to claim 6, wherein the ion discharge hole is formed at a position corresponding to the discharge unit.

8. The portable ion generator according to claim 1, wherein voltage applied to the discharge unit is pulse voltage, and the pulse voltage has different on time and off time lengths.

9. The portable ion generator according to claim 8, wherein the on time length of the pulse voltage applied to the discharge unit is shorter than the off time length of the pulse voltage applied to the discharge unit.

10. The portable ion generator according to claim 1, wherein the positive ion discharge unit and the negative ion discharge unit have a diameter of 30 mm or less, and the positive ion discharge unit and the negative ion discharge unit are disposed such that a distance between centers of the positive ion discharge unit and the negative ion discharge unit is approximately 20 mm or more.

11. The portable ion generator according to claim 1, wherein voltage applied to the high voltage generation unit is 11 volts to 13 volts.

12. The portable ion generator according to claim 11, further comprising an auxiliary boosting circuit for boosting direct current power supplied from the external direct current power supply terminal before supplying direct current power to the high voltage generation unit.

13. The portable ion generator according to claim 1, wherein the external direct current power supply terminal of the power supply unit comprises a universal serial bus (USB) port.

14. The portable ion generator according to claim 13, wherein the power supply unit is mounted so that the power supply unit is slidably drawn outward.

15. The portable ion generator according to claim 1, further comprising a battery for storing electrical energy supplied from the power supply unit.

16. The portable ion generator according to claim 15, wherein the battery is provided at a bottom of the lower board.

* * * * *